United States Patent [19]

Andreasson

[11] Patent Number: 5,040,926

[45] Date of Patent: Aug. 20, 1991

[54] PILING METHOD

[76] Inventor: Bo Andreasson, Vidblicksgatan 13, S-412 57 Göteborg, Sweden

[21] Appl. No.: 391,590

[22] PCT Filed: Feb. 3, 1988

[86] PCT No.: PCT/SE88/00034

§ 371 Date: Jul. 19, 1989

§ 102(e) Date: Jul. 19, 1989

[87] PCT Pub. No.: WO88/05843

PCT Pub. Date: Aug. 11, 1988

[30] Foreign Application Priority Data

Feb. 6, 1987 [SE] Sweden ..... 8700446

[51] Int. Cl.[5] ..... E02D 7/02

[52] U.S. Cl. ..... 405/232; 405/272; 166/385; 175/19

[58] Field of Search ..... 405/229, 230, 231, 232, 405/50, 274, 276, 277, 259, 51; 175/19; 166/77, 384, 385

[56] References Cited

U.S. PATENT DOCUMENTS

| | | | |
|---|---|---|---|
| 3,631,933 | 1/1972 | Bryant | 175/57 |
| 4,024,719 | 5/1977 | Risseuw | 405/232 |
| 4,097,854 | 6/1978 | Black et al. | 405/259 X |
| 4,166,508 | 9/1979 | Van den Berg | 405/50 X |
| 4,504,175 | 3/1985 | Zion | 405/259 X |
| 4,589,803 | 5/1986 | Totten, III | 405/259 |
| 4,755,080 | 7/1988 | Cortlever et al. | 405/232 X |

FOREIGN PATENT DOCUMENTS

| | | | |
|---|---|---|---|
| 0041509 | 3/1984 | Japan | 405/50 |
| 102311 | 8/1941 | Switzerland | 405/50 |
| 0981511 | 12/1982 | U.S.S.R. | 405/232 |

OTHER PUBLICATIONS

"Forming and Forging", Metals Handbook, Ninth Edition, vol. 14, pp. 624–635.

"Foundation Design and Construction", M. J. Tomlinson, Fourth Edition, ©1983, pp. 475–477.

"Foundation Engineering", G. A. Leonards, McGraw-Hill Book Company, Inc., ©1962, pp. 709–710.

*Primary Examiner*—Dennis L. Taylor
*Assistant Examiner*—Franco S. De Liguori
*Attorney, Agent, or Firm*—Cushman, Darby & Cushman

[57] ABSTRACT

To manufacture a pile which is intended to take compressive as well as tensile loads or to serve as a reinforcement member in soils, a strip is wound off a roll of strip material and is carried through a rotating-roller shaping unit in which the strip is shaped by rollers. If desired, the unit is operated in such a manner that it forms a bend in the direction of pile advancement. A pile thus shaped is driven from the roller shaping unit by means of pressure in arbitrary directions into the mass of an earth layer. Upon attainment of the desired depth of penetration and/or pile length the pile is severed at or close to the upper surface of the earth layer.

8 Claims, 5 Drawing Sheets

PILING METHOD

BACKGROUND OF THE INVENTION

The present invention relates to a method of manufacturing piles in situ immediately prior to the use thereof for foundation, ground reinforcement or soil stabilization purposes.

In conventional piling operations, piles made from concrete, wood or steel are generally used. Whichever type of pile that is used, the length of the manufactured pile is generally restricted, although the pile lengths may vary from a few meters up to several tens of meters. It is quite difficult to handle and manipulate very long piles, and to drive them down into the ground requires machinery equipped with a high tower. Shorter piles must be formed with interconnecting means allowing the piles to be joined together, and such interconnecting means often increase the pile manufacturing costs considerably, in addition to which the operations of joining the pile sections together during the piling work is quite time-consuming.

In conventional piling operations the piles are usually driven down into the ground with the aid of some kind of percussion equipment. Such equipment generates heavy vibrations and noise when in use, which could constitute an environmental disturbance.

SUMMARY OF THE INVENTION

The present invention provides a method allowing various types of piling operations to be performed in a considerably more simple and therefore less expensive manner, while at the same time reducing vibrations and noise to a minimum.

The method in accordance with the invention is characterized therein that a strip, preferably made from steel, is wound off a roll and is carried through a rotating-roller shaping unit of a king known per se, in which unit the strip is subjected to plastic deformation in its lengthwise extension, whereby the strip is imparted with a desired predetermined cross-sectional profile configuration, that the pile thus shaped, when leaving the roller shaping unit, is driven downwards or laterally into an earth layer by means of pressure on the pile, and in that, upon attainment of the desired penetration depth and/or the desired pile, length the pile is severed level with or close to the ground surface.

BRIEF DESCRIPTION OF THE DRAWINGS

Various embodiments of the pile in accordance with the invention and the method of driving the pile into the ground will be described in closer detail in the following with reference to the accompanying drawings, wherein.

DETAILED DESCRIPTION OF A PREFERRED EMBODIMENT

Figure 1:
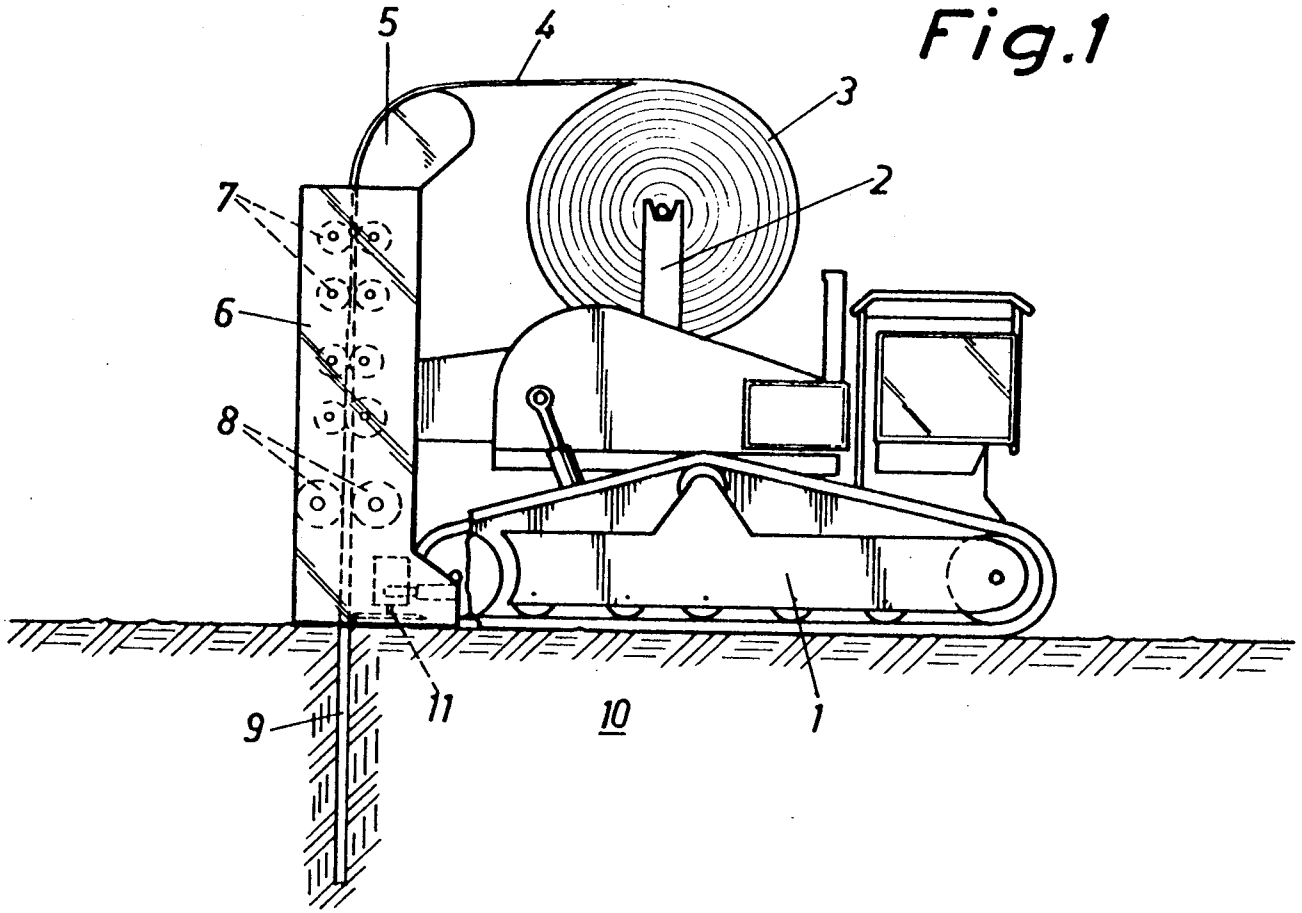
FIG. 1 is a lateral view of a utility vehicle fitted with the piling equipment in accordance with the invention.

FIG. 1 illustrates a vehicle 1 serving as a utility vehicle when performing the piling operations. The vehicle is equipped on its upper portion with a roller stand 2 which supports a roll 3 of a strip material 4. The strip 4 is carried over a deflector rail 5 and fed into a rotating-roller shaping unit 6. The basic structure of this unit is of a prior-art nature and includes pairs of rollers 7 which are designed to shape the initially flat strip blank during the successive advancement of the strip 4 into the desired predetermined cross-sectional profile configuration. A pair of driving wheels 8 formed integrally with the shaping unit 6 are positioned one on either side of the shaped strip. The purpose of the driving wheels 8 is to drive the pile 9 thus shaped by pressing it down to the desired penetration depth in the underlying earth layers 10. Below the driving wheels 8, a severing means 11 is located, by means of which the pile 9, when having been driven down into the desired position, may be cut off at ground level. The severing means may be, e.g., hydraulically operated scissors.

The utility vehicle 1, which may be of moderate size, can then be moved to the next place of piling.

The shaping procedure is a rapid one. The strip 4 may be advanced at the speed of some ten meters per minute, or even more. The pile 9 thus formed successively, may be installed in any desired direction.

Figure 2:
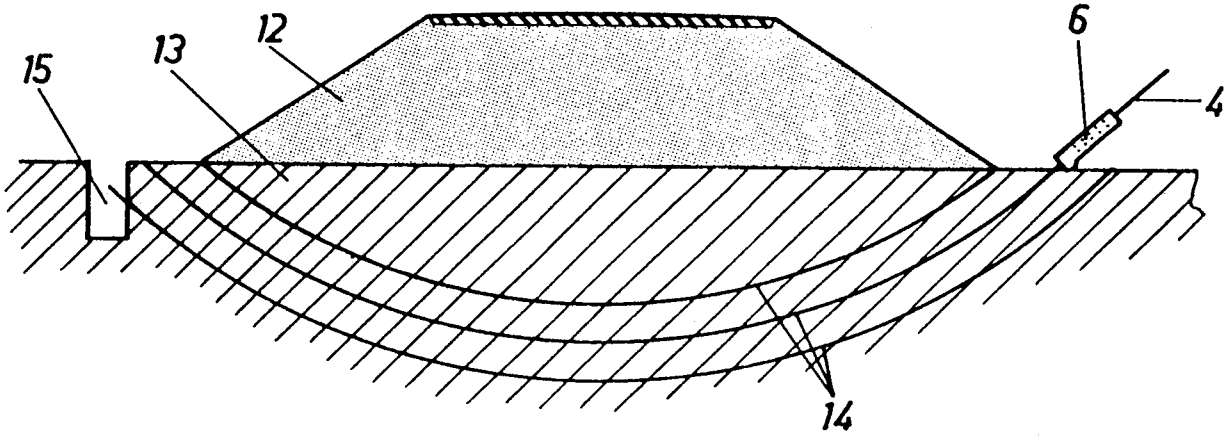
FIG. 2 is a cross-sectional view through a road embankment stabilized by piling.

FIG. 2 shows a situation according to which the earth layer 13 underlying a road embankment 12 needs to be reinforced/stabilized. With the use of the shaping unit 6 it becomes possible, in accordance with the teachings of the invention, to form piles 14 from the strip 4. While being driven down into the ground on one side of the road embankment 12, the pile 14 follows a curve in the vertical plane and thus it reappears from the ground on the opposite side of the road embankment 12. To anchor the ends of the piles 14, a shaft 15 may be excavated laterally of the embankment 12. In this case, the primary purpose of the piles 14 is to absorb tensile stress, and, in this manner, they act as soil stability reinforcement means. The installment of such curved profiled piles 14 in accordance with the invention reduces the need of, e.g., load-supporting embankments.

Owing to the considerable rigidity of the piles 14, they will attribute considerably to the resulting increased stability of the earth layer 13. The result is that, e.g., the effects of the dynamic load caused by moving vehicles, such as trains, trucks and similar vehicles, which load is transferred to the earth layer 13, may be reduced to a considerable degree.

Similar soil stability improving measures may be taken also in layers of loose and unconsolidated soils in order to reduce the effects of detrimental vibrations due to earthquakes.

Figure 3:
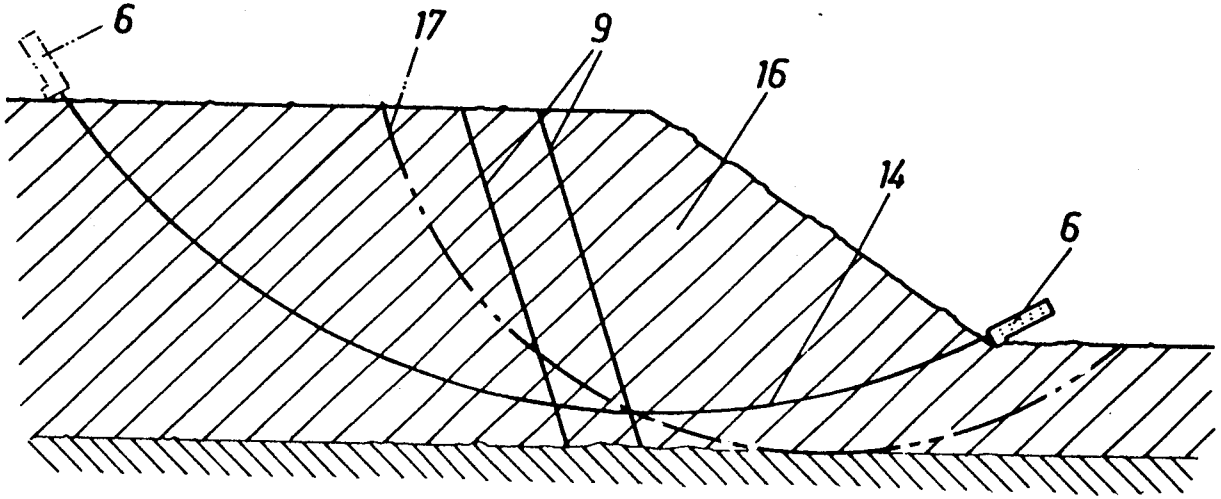
FIG. 3 is a sectional view through a slope stabilized in a similar manner.

FIG. 3 shows one exemplary application of the novel piling technique used for stabilization of a slope 16. The dash-and-dot line 17 marks the estimated potential sliding curve of sliding masses of earth in the slope 16. Conventional piling using percussion techniques often cannot be recommended in situations similar to the one illustrated, because of the vibrations which are generated under such circumstances and which cause displacement of considerable masses of earth during the piling operation. The stability of the slope could possibly be improved by providing some kind of ground anchors inside the mass of the slope 16. However, the installment of such anchors is very costly.

In accordance with the teachings of the invention, two piles 9 could instead be forced down into the mass of the slope as illustrated in FIG. 3, without generation of vibrations or displacement of large masses of earth. As an alternative to or in addition to these piles 9, one or several curved piles 14 may be driven into the slope 16 in the manner indicated in FIG. 3, either from the front or from above. The method and equipment in accordance with the invention thus allow improvement of slope stabilitity in a manner which is both less expensive and safer than the conventional technique used hitherto.

Figure 4A:
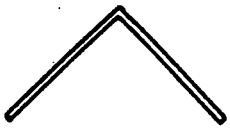
FIG. 4*a* through 4*e* show, by way of example, end views of various piles in accordance with the invention.
Figure 4B:
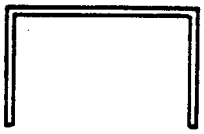
Figure 4C:
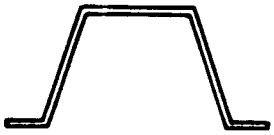
Figure 4D:
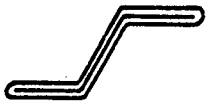
Figure 4E:
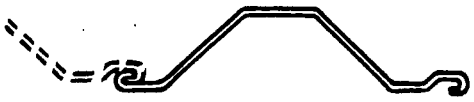

FIGS. 4*a* through 4*e* show examples of various pile profile configurations. From a geotechnical viewpoint it is essential that the pile possesses maximum rigidity and maximum surface area. FIG. 4*d* illustrates an embodiment the profile configuration of which is intended to be obtained from a strip which, already when wound into the roll 3, forms a closed shape. As an alternative to driving a thus-shaped pile into the ground it is possible to force it laterally into an earth layer in which case the shaping unit is positioned in a shaft. As soon as the profiled strip is in position in the ground in such a manner that after severing of the strip it extends for instance between two shafts, it becomes possible to apply an excess pressure in the interior of the strip, whereby the strip expands into a tubular shape. The leading end of the profile strip should be closed in a suitable manner, FIG. 4*e* shows an embodiment according to which the strip 4 is given a profile configuration allowing one section, when positioned in the ground in order to serve as a pile, to be hooked onto the adjoining section in the manner of a sheet pile, and, with the aid of such pile sections, it becomes possible successively to form a sheet pile wall.

Figure 5:
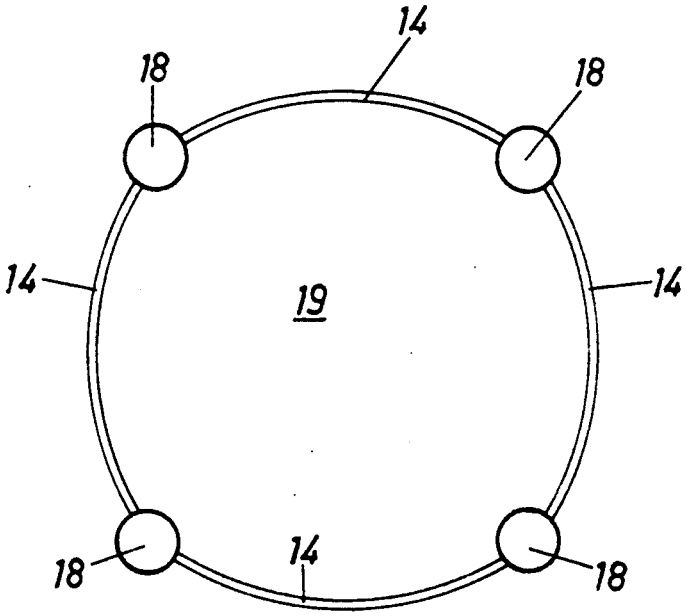
FIG. 5 is a schematical plan view of an arrangement including four installation shafts with an intermediate "pile wall"

FIG. 5 represents schematically an arrangement consisting of four shafts 18 which are excavated in a circular array and which are spaced a predetermined distance apart. From the excavated shafts 18, piles 14 are driven laterally into the earth in the manner taught by the invention, the shaping unit 6 then being set in a manner causing the piles to extend along a predetermined curved line in the horizontal plane from one well or shaft to the next. In this manner it becomes possible to form "rib cage" pile walls which facilitate excavation operations in the entire ground area 19 interiorly of the shafts 18. Such "rib cage" structures could also be erected with vertically directed piles 14.

Figure 6:
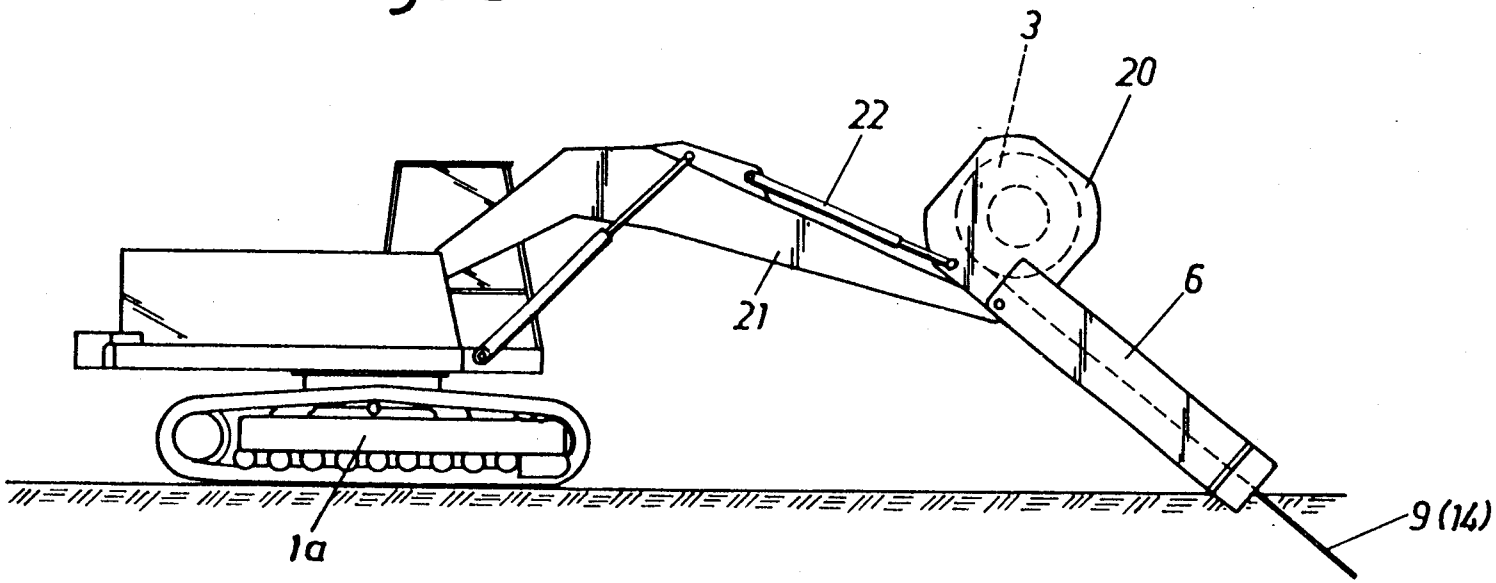
FIG. 6 is a lateral view of a modified embodiment of the utility vehicle illustrated in FIG. 1.

FIG. 6 shows a somewhat modified utility vehicle 1*a*. The roll 3 of strip material is enclosed inside a cartridge 20 mounted on the roller shaping unit 6, the latter being articulated to an extension arm 21 on the vehicle 1*a*. The roller shaping unit 6 and the cartridge 20 are mounted for joint pivotal movement by means of a hydraulic piston-and-cylinder unit 22, allowing them to assume various angular positions, either inwards towards the utility vehicle 1*a*, or outwards, as illustrated in the drawing figure. This arrangement facilitates the insertion or forcing downwards of the pile 9, 14 into the ground under the conditions outlined above.

The pile 9, 14, in its various applications, is primarily intended to be used in loose soils, such as normally-consolidated clay. However, it could also be used in more compact types of soil. The method in accordance with the invention, when applied in clay soils, makes use of the principle that the force required when the pile 9, 14 is driven into the ground is considerably smaller than the load-absorbing capacity of the pile. This is due to the "breaking up" of the soil with consequential reduction of the strength which occurs as a result of the installation of the pile. The force required to drive the pile downwards or inwards thus is reduced, which means that the equipment could be made accordingly smaller and more compact. By means of reversing pulses, the resistance of the pile against the driving-down into the clay is further reduced because of the increased "breaking up" of the clay. However, in time the clay settles and resumes its original strength.

By measuring the resistance of the pile against being driven down it becomes possible to determine the load-bearing capacity of the pile.

A further application of the pile in accordance with the invention is as an anchoring member to resist lateral pulling forces, e.g. as sheet pile anchoring member. Hitherto, anchorage of this kind has consisted primarily of stays (wires) which are secured in rock by means of drilling or in other types of anchoring bodies (injection zone). Forcing a pile 14 laterally into the soil in the manner in accordance with the invention provides a more simple and less expensive solution to this problem.

The invention is not limited to the embodiments described in the aforegoing and illustrated in the drawings, but could be modified in a variety of ways within the scope of the appended claims. In order to reduce the weight of the strip 4 and in order to increase the efficiency in certain types of soil, the strip 4 could be perforated prior to or in connection with the profile-shaping process. During the shaping process it is also possible to form the strip 4 with bumps or projections.

The strip 4 could be pre-treated prior to the shaping process. It could, for instance, be covered with a coat of paint or it could be electroplated. Other materials than steel could be used, such as aluminium.

What I claim is:

1. A method for manufacturing a pile in the ground in situ, comprising:

(a) providing a flat strip of plastically deformable pile stock material on a roll having a leading end, so that the strip has a length, a width and a thickness;

(b) while unwinding the strip from the roll, leading end first, passing successive increments of the unwound strip through a rotating roller-type shaping unit which plastically deforms the strip so that its profile, as seen in transverse cross-section, becomes less flat and more bent than when said strip was on said roll;

(c) while conducting step (b), by pressing longitudinally forward on said unwound strip, forcibly driving said unwound strip downstream of said rotating roller-type shaping unit into the ground to define a pile; and (d) upon attainment of a desired length of insertion of said pile into the ground, severing said pile from said unwound strip at a point level with or close to the ground.

2. The method of claim 1, wherein in conducting step (b), the unwound strip is provided by said rotating roller-type shaping unit with a curvature about an axis transverse to opposite faces of said unwound strip, so that, as step (c) is conducted, the pile is inserted into the ground along a curved path.

3. The method of claim 2, wherein:

as a result of conducting step (c), the leading end of the pile emerges from the ground at a site remote from where the leading end of the pile was inserted in step (c), before step (d) is conducted.

4. The method of claim 1, wherein:

while conducting step (c), the pile is inserted non-vertically into the ground.

5. The method of claim 1, wherein:

step (b) further comprises perforating successive increments of said unwound strip before conducting step (c).

6. The method of claim 1, wherein:

step (b) further comprises forming bumps on one face of said unwound strip and corresponding depressions in an opposite face thereof, on successive increments of said unwound strip before conducting step (c).

7. The method of claim 1, wherein:

said strip is of flattened tubular form and said method further comprises the step of opening up a longitudinal bore in the pile upstream of the leading end thereof after conducting step (d).

8. The method of claim 1, further comprising:

subsequent to conducting step (d), conducting steps (b) and (c) on a succeeding increment of said strip, beside the first-installed said pile, and while thus-installing a second said pile, hooking the second said pile with the first-installed said pile, thereby providing sheet piling made of said first-installed and second said piles.

* * * * *